US005176019A

United States Patent [19]

Brooks, Jr.

[11] Patent Number: 5,176,019

[45] Date of Patent: Jan. 5, 1993

[54] FORMING OF METAL STRUCTURAL MEMBERS

[75] Inventor: Barlow W. Brooks, Jr., Anchorage, Ky.

[73] Assignee: Roll Forming Corporation, Shelbyville, Ky.

[21] Appl. No.: 568,361

[22] Filed: Aug. 16, 1990

[51] Int. Cl.[5] ..... B21D 5/14

[52] U.S. Cl. ..... 72/181; 72/176

[58] Field of Search ..... 72/176–182, 72/214

[56] References Cited

U.S. PATENT DOCUMENTS

| | | | |
|---|---|---|---|
| 489,498 | 1/1893 | Pruden | 72/180 |
| 2,397,608 | 2/1942 | Johnson | 72/245 |
| 2,497,043 | 2/1950 | Gerts | 72/176 |
| 2,799,317 | 7/1957 | Toulman, Jr. . | |
| 3,628,361 | 12/1971 | DeRupa | 72/181 |
| 3,733,868 | 5/1973 | Welty | 72/181 |
| 3,756,057 | 4/1973 | Brooks, Jr. et al. | 72/181 |
| 3,903,723 | 9/1975 | Colbath | 72/181 |
| 4,006,617 | 2/1977 | Foster | 72/181 |
| 4,109,499 | 8/1978 | Brooks et al. | 72/181 |
| 4,117,702 | 10/1978 | Foster | 72/173 |
| 4,271,777 | 6/1981 | Collins | 72/176 |
| 4,558,577 | 12/1985 | Trishersky et al. | 72/181 |
| 4,770,018 | 9/1988 | Bosi et al. | 72/181 |

FOREIGN PATENT DOCUMENTS

| | | | |
|---|---|---|---|
| 86031 | 5/1986 | Japan | 72/176 |

OTHER PUBLICATIONS

Article "Roll Forming Advances Suit Today's Structures" by Weimer, *Iron Age* magazine, Apr. 7, 1980, pp. 57 & 59; copyright Chilton Company 1980; also included is magazine cover and p. 8.

*Primary Examiner*—Daniel C. Crane
*Attorney, Agent, or Firm*—Roger S. Dybvig

[57] ABSTRACT

A structural member having a complex shape, such as a return flange z-shape, is manufactured by confining a longitudinally-extending mid-portion of a metal strip between a pair of forming mandrels and running the mandrels and the strip as a unitary workpiece from pass-to-pass of a roll forming machine progressively to form the sheet metal about surfaces of both mandrels. The metal strip and the formed part may have a uniform thickness or may have varying thicknesses. The cross-sectional distribution of the metal mass along the length of the structural member may be modified from the original strip. The structural member may have one or more joggles using a mandrel or mandrels having a complementary recess for each joggle to be formed. In such case, one or more of the passes includes a forming roll assembly that is strongly biased, and or resiliently self-biased, toward each recessed portion of the mandrel to force the sheet metal into each such recess to complete the formation of a joggle. Joggles may be formed in structural members having shapes other than z-shapes. Equipment used in the manufacture of the structural members includes roll stands having appropriately-shaped forming rolls with surfaces that may move vertically, horizontally, or in other directions as needed to accommodate the shapes of the structural members to be formed.

14 Claims, 7 Drawing Sheets

FIG-1
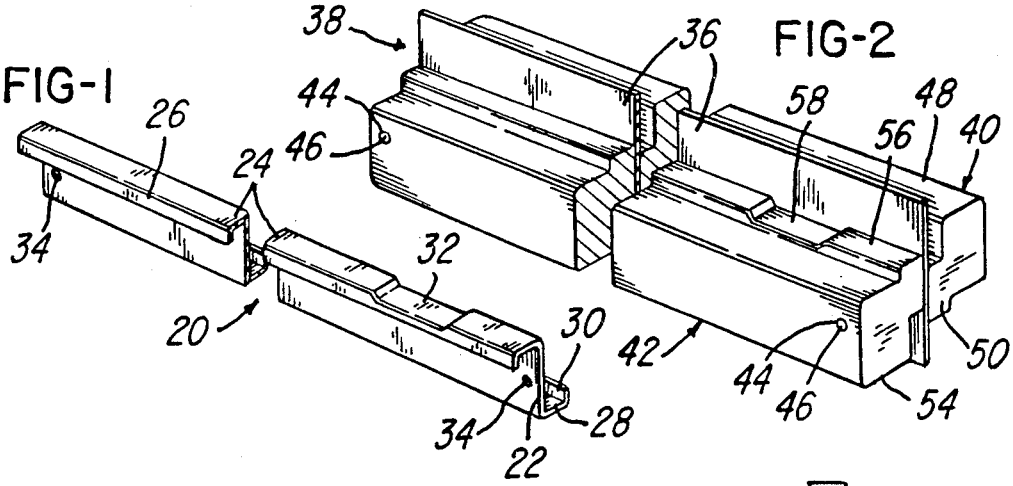
FIG-2
FIG-3
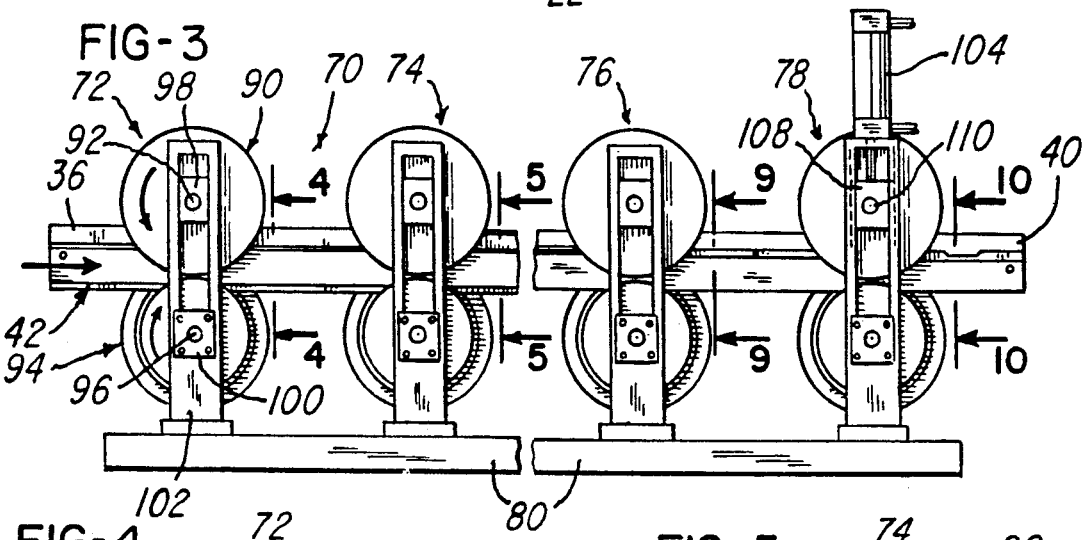
FIG-4
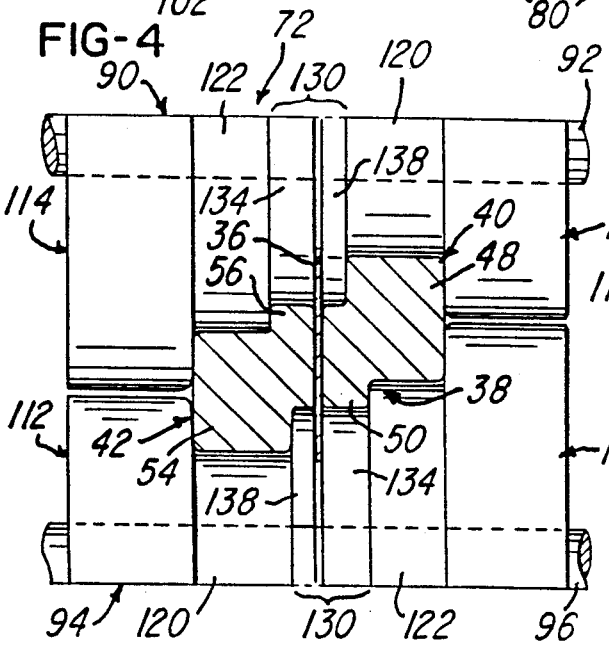
FIG-5
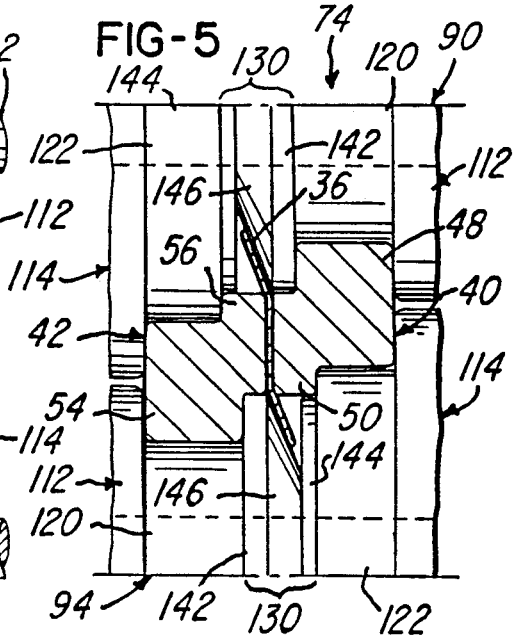

FIG-12
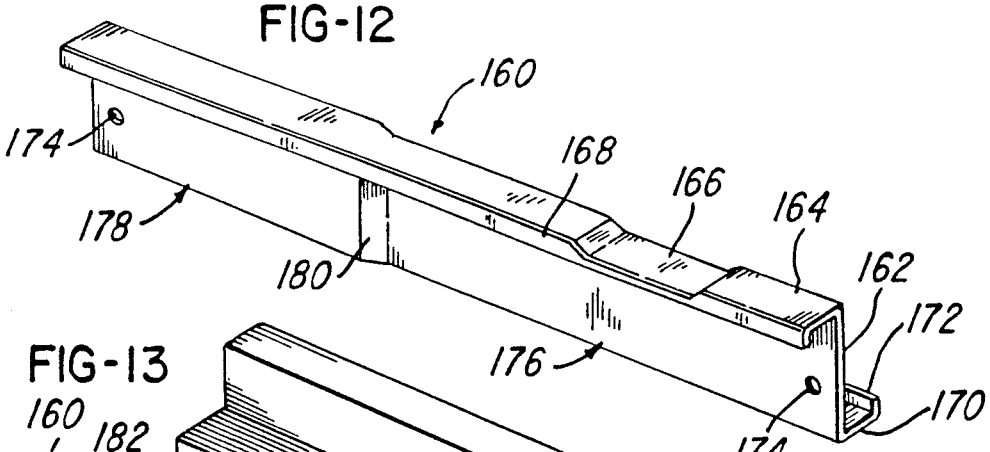
FIG-13
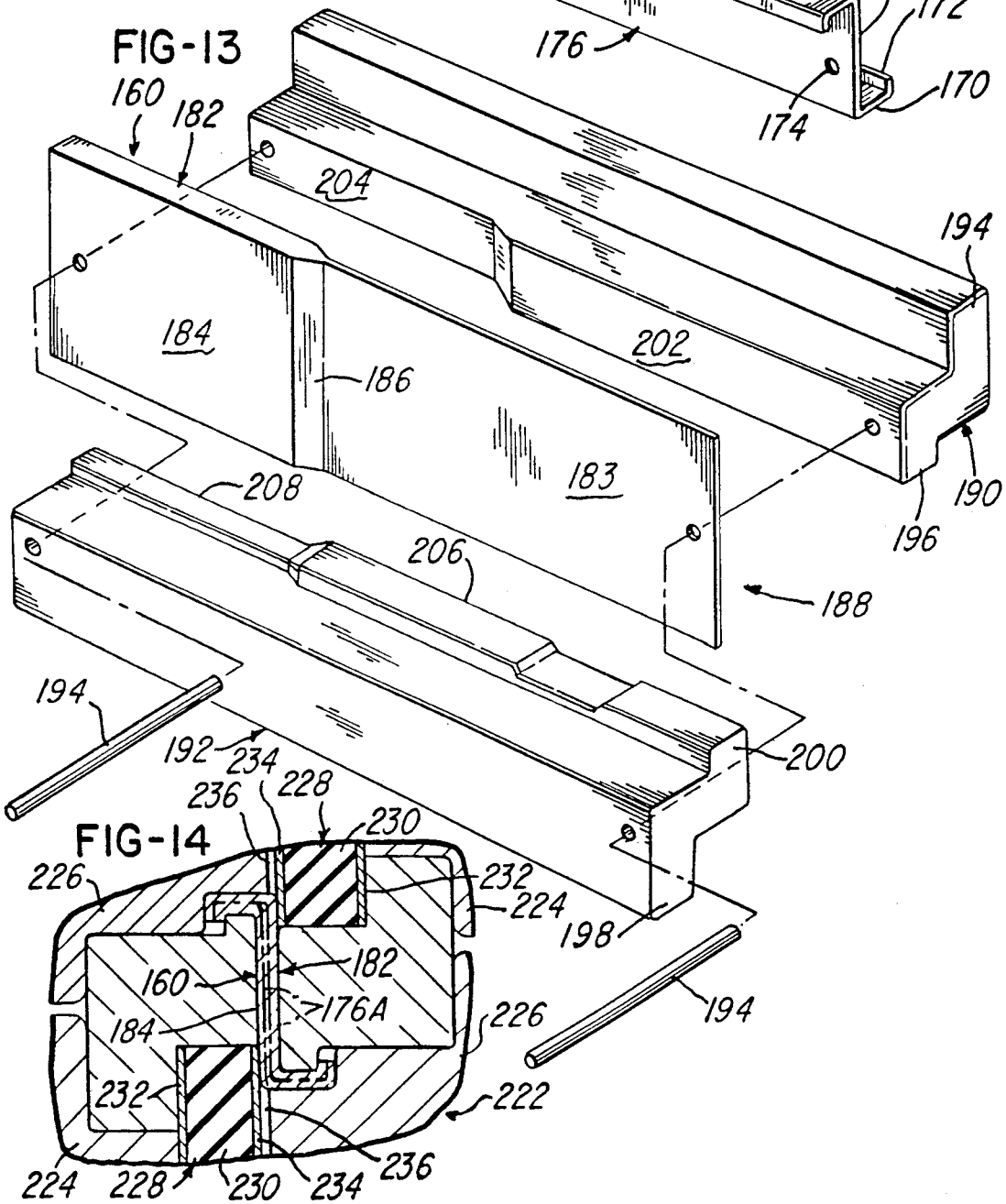
FIG-14

FORMING OF METAL STRUCTURAL MEMBERS

SUMMARY OF THE INVENTION

This invention relates to the formation of metal structural members such as used in the manufacture of aircraft frames and is applicable to metal structural members made from raw material that is in the form of an elongate, generally planar strip which is formed by a roll forming process into a non-planar configuration. An important application for this invention is the production of elongate Z-shaped structural members, especially those having "joggles", and the invention is disclosed for such application. However, the invention and various aspects of the invention are useful for producing structural members having other shapes.

An object of one aspect of this invention is to provide an improved method and apparatus for the economical production of both simple and complex structural members, including return flange Z-shaped members, which structural members have one or more joggles. A joggle is a shallow recess formed along a relatively short length of a complete structural member and usually along a planar or U-shaped portion thereof. The conventional method of forming a structural member with one or more joggles is to roll form the complete structural member and, as a separate, non-continuous operation, thereafter "crush" the structural member in a press especially tooled to create the joggle. This process abruptly changes the shape of the structural member and may cause excessive stress in or strains on parts of the structural member as they are stretched or compressed in order to accommodate the formation of the joggle. A related object of this invention is to enable the manufacture of a metal structural member having one or more joggles in one continuous operation. Still another related object is to reduce the stress in and the strain on a metal structural member caused by the formation of one or more joggles.

In accordance with this invention, a structural member having a joggle is formed by aligning a strip of raw sheet metal with a mandrel having surfaces over which at least parts of the structural member are to be formed, the mandrel having a complementary recess for each joggle to be formed, and running the mandrel and the sheet metal as a unitary workpiece through plural successive passes of a roll forming machine. Each pass has a forming roll assembly that engages the sheet metal to progressively increasingly form the sheet metal to the desired shape of the completed structural member. One or more of the last passes includes a forming roll assembly that is strongly biased, or resiliently self-biased, toward the portion of the mandrel which is recessed to form the joggle or joggles and the mandrel is so constructed that, as the mandrel and the sheet metal pass through the last pass or passes, the biased roll assembly forces the sheet metal overlying each joggle-forming mandrel recess to be forced into each such recess by a degree sufficient to complete the formation of a joggle therein. Biasing of the roll assembly is preferably accomplished by the use of a regulated hydraulic actuator, such as described in Brooks et al. U.S. Pat. No. 4,109,499, granted Aug. 29, 1978, but may be accomplished by the use of springs. A forming roll having a self-biasing elastomeric sleeve, such as disclosed in Brooks, Jr. et al. U.S. Pat. No. 3,756,057, granted Sep. 4, 1973, may also be used. The disclosures of both the Brooks et al. U.S. Pat. No. 4,109,499, and the Brooks, Jr. et al. U.S. Pat. No. 3,756,057, are hereby incorporated by reference herein.

The first roll assembly, or first several successive roll assemblies, through which the mandrel and the sheet metal pass are either not biased to force the sheet metal into the mandrel recess or are biased but prevented by the construction of the roll assembly from forcing the sheet metal to any great extent into the mandrel recess. However, I have discovered that each joggle is partly and progressively formed at successive passes of the roll forming machine, apparently because the mandrel-facing surface portion of the sheet metal overlying a mandrel recess is not supported by the mandrel. Because of the progressive formation of each joggle, the final joggle-forming step or steps causes substantially less formation of stress in the sheet metal adjacent the joggle than is caused by conventional crush forming of joggles.

The step of aligning the sheet metal with a mandrel is necessary to carry out a joggle-forming method in accordance with this invention, but in some cases the mandrel may be formed from an endless loop of plural interconnected mandrel sections or may be part of an endless loop of interconnected mandrels that circulate continuously through the successive passes of a roll forming machine as described in relation to FIGS. 3 and 7–9 of said Brooks, Jr. et al. '057 patent. With circulating mandrel sections, the setup shown in FIG. 3 of said Brooks, Jr. et al. '057 patent may be used in which event the alignment of the sheet metal with the mandrel normally occurs automatically and require no additional setup time. If a circulating loop of mandrel sections cannot be used because of the configuration of the metal structural member to be formed, the time required to accomplish the alignment of the sheet metal with the mandrel (or mandrels as discussed below) would be required whether or not a joggle is to be formed Thus, a process for producing joggles in accordance with this invention should in every case result in a savings of time and use of equipment because the step of forming joggles as a completely separate operation is avoided. The savings in time and costs resulting from forming joggles in accordance with this invention will probably always be significant.

An object of another aspect of this invention is to provide an improved method and apparatus for the economical production of complex structural members. A related, more specific object of this invention to provide an improved method and apparatus for the economical production of return flange Z-shaped structural members.

An object of another, related, aspect of this invention is to provide an improved method and apparatus for the economical production of both simple and complex structural members, including return flange Z-shaped members, which structural members have cross-sectional thicknesses that differ at different portions or regions along the length of the structural members.

An object of yet another aspect of this invention is to provide an improved method and apparatus for the economical roll forming of either a simple or a complex structural member, such as a return flange Z-shaped member, which structural member has controllably different distributions of the sheet metal mass with respect to the original transverse centerline or centerlines of the raw metal strip used to form the structural member.

Other objects of other aspects of this invention are to provide improved methods and apparatus for the economical production of both simple and complex structural members, including return flange Z-shaped members, having two or more of the above-noted characteristics, namely: one or more joggles; cross-sectional thicknesses that differ at different portions or regions along the length of the structural members; or controllably different distributions of a sheet metal mass with respect to its original transverse centerline or centerlines.

A complex structural member, for example, a return flange Z-shaped structural member, may be manufactured in accordance with an aspect of this invention from a planar, uniformly thick, sheet metal strip by confining a longitudinally-extending mid-portion of the metal strip between a pair of forming mandrels and running the mandrels and the strip as a unitary workpiece from pass-to-pass of a roll forming machine. The mandrels and the forming roll assemblies are so contoured that the metal strip is progressively formed about surfaces of both mandrels by the roll assemblies. If desired, any differences in metal thickness due to manufacturing tolerances can be accommodated by utilizing roll assemblies which are biased by a constant pressure, as described in said Brooks et al. '499 patent.

In accordance with another aspect of this invention, a complex structural member having substantially different thicknesses along its length may be manufactured by first producing by a reduction rolling mill process a generally planar sheet metal blank having the desired different thicknesses for the longitudinally-extending portions or regions for each length thereof used to form a single structural member, providing a pair of elongate mandrels having confronting surfaces for engaging lengthwise along the opposite sides of the sheet metal blank, which mandrels are appropriately contoured for the changes in metal thickness and for any desired redistribution of the metal mass relative to its transverse centerline or centerlines, assembling the mandrels and the sheet metal blank into a unitary workpiece, and running the workpiece so formed through successive passes of a roll forming machine to cause parts of the structural member to be formed between the mandrels and other parts to be formed between the roll assemblies of the several passes and the mandrels.

Essentially the same method described in the immediately preceding paragraph may be used for the continuous production of plural, connected, complex structural members having substantially different thicknesses along their length, except that the sheet metal blank is necessarily formed to have a repeated pattern of thickness variations for producing a repeated series of structural members, and mandrels sufficiently long to produce several structural members are used, or else a pair of continuous mandrels are used. After forming, the continuously formed and connected structural members are cut apart from one another.

Complex structural members formed in accordance with this invention may be asymmetrical. For example, the upper and lower legs or flanges of a return flange Z-shaped structural member having respectively different lengths or shapes could be made in accordance with this invention. As one option, an increase in the thickness of the sheet metal strip could be used to cause the upper surface of the upper leg to step up relative to adjacent upper surfaces of the same leg but simply make the lower leg thicker so that the increased thickness is distributed to the upper surface of the lower leg. Numerous variations in shape are possible as will become more apparent from the description that follows.

Apparatus in accordance with this invention includes mandrels shaped to provide surfaces over which the structural members are formed and other surfaces between which parts of the structural members may be clamped, and roll forming tooling appropriate to carry out the forming methods of this invention.

Other objects and advantages will become apparent from the following description and the drawings.

BRIEF DESCRIPTION OF THE DRAWINGS

FIG. 1 is a fragmentary perspective view of a return flange Z-shaped structural member of uniform metal thickness made in accordance with the method and apparatus of this invention.

FIG. 2 is a fragmentary perspective view of the raw sheet material used to manufacture the return flange Z-shaped structural member of FIG. 1 and a fragmentary perspective view of a pair of mandrels forming part of the apparatus of this invention. FIG. 2 also shows alignment pins that hold the assembled mandrels and raw metal together so that they travel as a unit through a roll forming machine.

FIG. 3 is a simplified fragmentary front elevational view of a portion of a roll forming machine especially tooled and operable in accordance with this invention and showing some of the progressive steps taken to form the return flange Z-shaped structural member of FIG. 1.

FIG. 4 is a fragmentary elevational view of the forming roll assemblies of the first pass of the roll forming machine of FIG. 3 as viewed in the direction of arrows 4—4 thereof and showing the raw sheet metal and the mandrels exiting therefrom in cross section.

FIG. 5 is a fragmentary elevational view of the forming roll assemblies of the second pass of the roll forming machine of FIG. 3 as viewed in the direction of arrows 5—5 thereof and showing the raw sheet metal and the mandrels exiting therefrom in cross section. A smaller segment of the forming roll assemblies is illustrated in FIG. 5 than is illustrated in FIG. 4.

FIGS. 9 and 10 show, respectively, the next to the last pass and the last pass as viewed, respectively, in the direction of arrows 9—9 and 10—10 of FIG. 3.

FIG. 12 is a perspective view of one embodiment of a return flange Z-shaped structural member having different metal thicknesses made in accordance with this invention.

FIG. 13 is an enlarged, exploded perspective view of a pair of mandrels and the raw sheet metal used to form the return flange Z-shaped structural member of FIG. 12. FIG. 13 also shows alignment pins that may be used to hold the assembled mandrels and the raw metal together so that they travel as a unit through a roll forming machine.

FIG. 14 is a view similar to FIG. 10 or FIG. 11 showing a last pass of a roll forming machine used to manufacture the return flange Z-shaped structural member of FIG. 12.

FIGS. 19, 20, and 22 are viewed respectively in the direction of arrows 19—19, 20—20, and 22—22 of FIG. 17.

DETAILED DESCRIPTION

Figure 6:
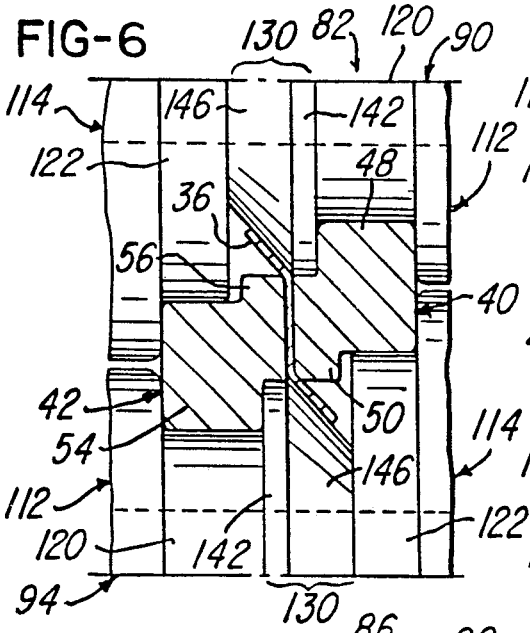
FIGS. 6, 7, 8, 9, and 10 are fragmentary elevational views similar to FIG. 5 of successive passes of the roll forming machine of FIG. 3 and showing progressive steps in the formation of the return flange Z-shaped structural member of FIG. 1.

FIG. 1 illustrates an elongate, return flange Z-shaped structural member, generally designated 20, comprising a central web 22, an upper leg 24 having an upper return flange 26 projecting downwardly from its outer edge, and a lower leg 28 having a lower return flange 30 extending upwardly from its outer edge. Here it should be noted that relative terms such as "upper", "lower", "inner", "outer", "above", "below", "right", "left", "horizontal", and "vertical" are used for convenience in a relative sense and not in an absolute sense in this description.

It may be noted in FIG. 1 that the upper leg 24, its return flange 26, and the upper portion of the central web 22 form an inverted U-shaped section that is uniform along the entire length of the structural member 20 except where modified by a joggle 32. The structural member 20 shown in FIG. 1 is representative of return flange Z-shaped structural members that may be produced in accordance with this invention, and there may be only one or a series of joggles 32. There may also be one or more joggles (not shown) in the lower leg 28 and adjoining portions of the web 22 and the upwardly projecting lower return flange 30. A pair of alignment apertures 34, one passing through each end of the web 22, are optionally provided as an aid to manufacture as will be described below.

With reference to FIG. 2, the structural member 20 is made from raw material comprising an elongate, planar, thin-walled, uniformly thick, strip 36 of metal, such as an aluminum alloy or other metal suitable for roll forming. The strip 36 is at least as long as the structural member 20 but could be much longer than the structural member 20 and used successively and continuously to form numerous structural members 20 as will readily be understood by those familiar with the roll forming art.

In order to produce the structural member 20 of FIG. 1 from the strip 36, a unitary workpiece 38 is formed by assembling the strip 36 between a pair of elongate forming mandrels, namely, a right side forming mandrel 40 and a left side forming mandrel 42. Each of the forming mandrels have a pair of bores 44 extending therethrough spaced by the same distance as the alignment apertures 34 of the completed structural member 20. Such apertures 34 are located in the strip 36 preferably substantially along the longitudinal centerline thereof. When the mandrels 40 and 42 are assembled with the strip 36, alignment pins 46 are extended through the bores 44 and are lodged in both of the mandrels 40 and 42. The purpose of the alignment pins 46 is to insure that the mandrels 40 and 42 and the strip 36 run as a unit through a roll forming machine as will be described below. Depending upon the nature of the material and the shape of the structural member to be formed, the alignment pins 46 may not be needed.

The right side forming mandrel 40 comprises a roll-engaging body 48 which is generally rectangular in transverse cross section and made of metal or other substantially inelastic material. The right side mandrel body 48 has a protuberant forming rail 50 extending along the entire length of its lower left side portion.

As will be further described below, the roll engaging mandrel body 48 is driven and guided by the forming roll assemblies of a roll forming machine while a part of the strip 36 is being formed over the bottom of the right side forming rail 50. At the same time, the leftmost surface of the right side forming rail 50 engage the right side face of the strip 36 to help control its shape and also to serve as a spacer to enable a part of the upper forming roll assembly 90 to engage the upper portion of the metal strip 36.

The left side forming mandrel 42 also comprises a rigid rod of metal or other substantially inelastic material and has a roll-engaging body 54, which is generally rectangular in transverse cross section, and a protuberant forming rail 56 extending along the entire length of its upper right side portion. The left side forming mandrel 42 performs essentially the same function as the right side forming mandrel 40 as will become apparent. In the mandrel embodiment illustrated in FIG. 2, the left side forming mandrel 42 is constructed identically to the right side forming mandrel 40, except that the upper surface of the forming rail 56 of the left side forming mandrel 42 has a shallow recess 58 adjacent one end thereof used when a joggle 32 is to be formed in the upper leg 24 of the return flange Z-shaped structural member 20.

With reference to FIG. 3, a portion of a roll forming machine, generally designated 70, illustrated in simplified form, is shown tooled to progressively form a planar metal strip 36 into one or more return flange Z-shaped structural members 20. Further information regarding the roll forming machine of this type is contained in said Brooks, Jr. et al. U.S. Pat. No. 3,756,057 and said Brooks et al. U.S. Pat. No. 4,109,499. The portions of the machine 70 illustrated in FIG. 3 include four forming stations or "passes" generally designated 72, 74, 76 and 78 mounted on a horizontal machine bed plate 80. The passes 72 and 74 to the left side of FIG. 3 are the first and second passes, respectively. The passes 76 and 78 to the right side of FIG. 3 are the next to the last and the last, respectively. Parts of these passes are shown respectively in FIGS. 4, 5, 9, and 10. Sections of passes intermediate these passes comprise a third pass 82 shown in FIG. 6, a fourth pass 84 shown in FIG. 7 and a fifth pass 86 shown in FIG. 8. The illustrated passes are exemplary and there would be at least one other pass, located between passes 76 and 86, which is not illustrated. Some of the passes, and particularly the last pass, may be substantially duplicated one or more times to insure that the formed structural member 20 better retains its shape. Some structural members may require the use of more passes while other structural members may require the use of fewer passes.

Referring to FIGS. 3 and 4, the first pass 72 comprises an upper forming roll assembly, generally designated 90, affixed to an upper roll spindle 92 for rotation therewith and a lower forming roll assembly, generally designated 94, affixed to a lower roll spindle 96 for rotation therewith. The upper roll spindle 92 and the lower roll spindle 96 are mounted, respectively, for rotation within upper bearings 98 and lower bearings 100 of a pair of spaced roll stand housings 102 mounted on the machine bed plate 80. Only one of the roll stand housings 102 is illustrated in FIG. 3, the other being hidden from view. Either one or both of the roll spindles 92 and 96 may be rotatably driven by a suitable drive mechanism which may be entirely conventional. See, for example, FIG. 5 of said Brooks, Jr. et al. '057 patent and FIG. 1 of said Brooks et al. '499 patent. Aside from differences in the formation of the upper and lower forming rolls, all of the other passes, except for the last pass 78, of the roll forming machine 70 are constructed identically to the first pass 72, and like reference numbers are applied to like parts. The last pas 78 is essentially the same as the other passes but includes a pair of hydraulic cylinders 104, only one of which is illustrated in FIG. 3, for applying a downward bias to its upper bearings, designated 108, that support its upper roll spindle, designated 110. The construction and operation of the last pass 78 may be more fully understood by reference to said Brooks et al. '499 patent and in particular to FIG. 4 thereof.

The several upper and lower forming roll assemblies 90 and 94 cooperate to move the unitary workpiece 38 in a straight, horizontal path through the several passes and to progressively form the upper and lower portions of the strip 36 over the adjacent surfaces, respectively, of the left-side forming rail 56 and the right-side forming rail 50. Because the return flange Z-shaped structural member 20 to be formed is, but for the joggle 32, symmetrical about a horizontal plane passing through its longitudinal centerline, the lower forming roll assembly 94 of the first pass 72 may be constructed identically, but oppositely, to its upper roll assembly 90, and like parts are given like reference numbers. This is true also of the upper and lower forming roll assemblies 90 and 94 of all other passes, with the exception of the last pass or passes used to finally form the joggle 32, as will be discussed below.

With reference to FIGS. 4 through 10, each upper roll assembly 90 comprises mutually spaced and confronting side roll sections, namely, a right side roll section 112 and a left side roll section 114, each of the side roll sections 112 and 114 having a vertical surface engaging the opposite sides, respectively, of the right side mandrel 40 and the left side mandrel 42 to laterally confine the workpiece 38 during its travel through the roll forming machine 70. Each lower roll assembly 94 has the same, but oppositely located, mutually spaced and confronting side roll sections 112 and 114. Thus, the lower left side roll section is designated 112 and the lower right side roll section is designated 114.

To confine the workpiece 38 for movement in a horizontal plane, each upper forming roll assembly 90 has a right side mandrel-engaging intermediate roll section 120 for engaging the top surface of the roll-engaging body 48 of the right side mandrel 40 and a left side mandrel-engaging, intermediate roll section 122 for engaging the top surface of the roll-engaging body 54 of the left side mandrel 42, and each lower roll assembly 94 has a corresponding first, mandrel-engaging, intermediate roll section 120 for engaging the bottom surface of the roll-engaging body 54 of the left side mandrel 42 and a second, mandrel-engaging, intermediate roll section 122 for engaging the bottom surface of the roll-engaging body 48 of the right side mandrel 40.

In between the upper and lower intermediate roll sections 120 and 122 are various upper and lower, central, part-forming, roll sections, generally designated 130, that progressively form the metal strip 36 over surface portions of the forming rails 50 and 56. The central roll sections 130 of successive passes have both mandrel rail-engaging subsections and part-forming subsections appropriate to the task performed at each pass. Thus, in the first pass 72 illustrated in FIGS. 3 and 4, which is used only to establish the proper alignment of the workpiece 38 with the successive roll assemblies and not to form the metal strip 36, the upper central roll section 130 comprises a center left, disc-shaped, mandrel rail-engaging subsection 134 that engages the upper surface of the left side forming rail 56. The corresponding lower right central roll subsection 134 engage the lower surface of the right side forming rail 50. The upper and lower portions of the strip 36 are confined for movement through channels formed between the above-mentioned center roll subsections 134 and upper right center and lower left center roll subsections 138, respectively.

In the second pass 74 illustrated in FIGS. 3 and 5, the upper central roll section 130 has three subsections comprising a first, right side, disc-shaped outer subsection 142 engaging the top surface of the forming rail 50 of the right side mandrel 40, a second, left side, disc-shaped subsection 144 engaging the top surface of the forming rail 56 of the left side mandrel 42, and a third, bevelled, center, part-forming subsection 146 engaging the upper right surface of the portion of the strip 36 engaged with the confronting face of the left side mandrel 42. The bevelled, center part-forming subsection 146 is constructed to begin bending the upper portion of the strip 36 to conform it to the upper surface of the forming rail 56 of the left side mandrel 42. During the forming operation taking place at the second pass 74, the center portion of the strip 36 is held against the inner surface of the left side forming rail 56 partly by the right side forming rail 50 and partly by the right side subsection 142. The lower roll subsections 142, 144, and 146 perform the same tasks as their corresponding upper roll sections and the lower, bevelled, center forming subsection 146 begins to bend the lower portion of the strip 36 to conform it to the lower surface of the forming rail 50 of the right side mandrel 40.

Figure 7:
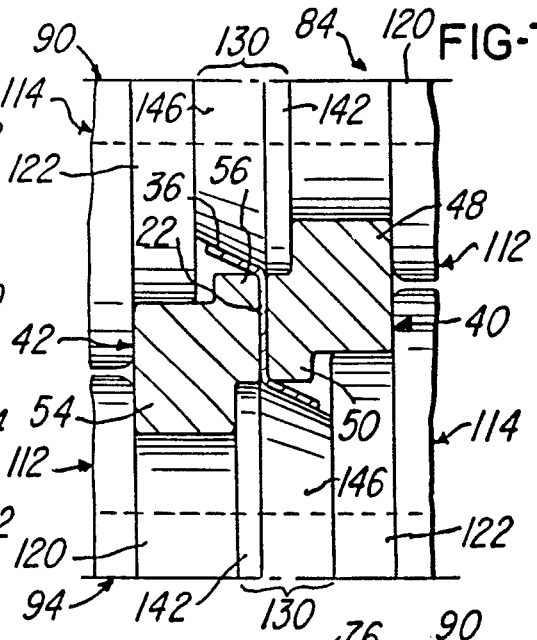

In the third pass 82 illustrated in FIG. 6 and the fourth pass 84 illustrated in FIG. 7, the bevelled, center subsections 146 are less sharply bevelled and are wider than the center subsections 146 of the second pass 74. Accordingly, there is no upper left side or lower right side disc-shaped subsection 144 and the intermediate roll sections 122 are diminished in width as needed to accommodate the wider center subsection 146.

Figure 8:
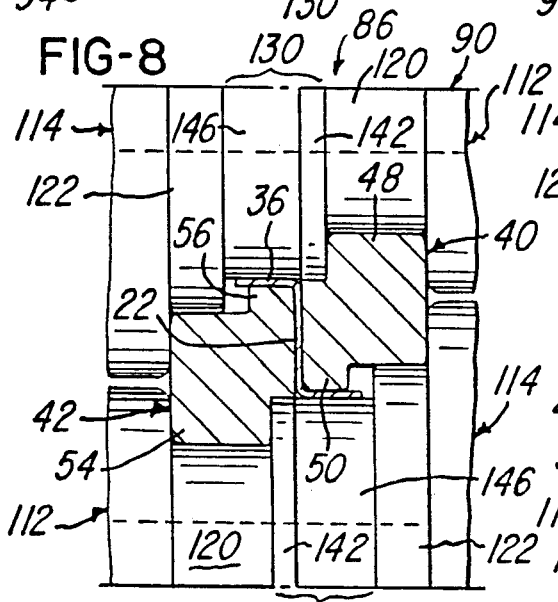

In the fifth pass 86 illustrated in FIG. 8, the center subsections 146 are disc-shaped and not bevelled so that the upper part of the strip 36 is formed to extend completely along the top surface of the left side forming rail 56, while the lower part of the strip 36 is formed to extend completely along the bottom surface of the right side forming rail 50.

Figure 9:
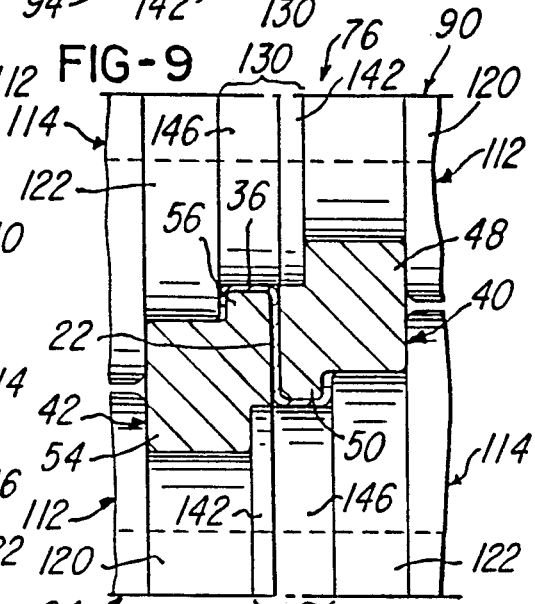

In the next to the last pass 76 illustrated in FIG. 9, the strip 36 is now fully engaged with the part-forming surfaces of the forming rails 50 and 56. It may be noted that one or more additional passes would be required between the fifth pass 86 shown in FIG. 5 and the next to the last pass 76 of FIG. 9 in order to bend the strip 36 to form the return flanges 26 and 30. The techniques for forming the return flanges 26 and 30 are well known and deemed obvious from the preceding figures of the drawing, so the passes used for this purpose are not illustrated.

In the next to the last pass 76, the central web 22 of the return flange Z-shaped structural member 20 is confined partly between the two forming rails 50 and 56 and partly between the respective forming rails 50 and 56 and the upper right side and lower left side, disc-shaped outer subsections 142. The upper and lower legs 24 and 28 of the structural member 20 are confined between the center subsections 146 and the forming rails 50 and 56 and the return flanges 26 and 30 are confined between the upper left side and lower right side intermediate roll sections 122 and the forming rails 56 and 50, respectively. The return flange Z-shaped structural member 20 is now completely formed except for the completion of the joggle 32.

To produce a structural member with one or more joggles without a separate joggle-forming operation and with lesser degrees of stresses and strains in the metal at and adjacent the joggle or joggles than occur as a result of crush joggle-forming processes, each joggle is progressively formed in accordance with this invention as the raw material strip moves along the succeeding passes of the roll forming machine 70. Thus, using the roll forming machine of FIG. 3, the joggle 32 is partly formed in the recess 58 in the upper face of the left side forming rail 56 as the recess 58 enters the second pass 74 and progressively further formed as the workpiece continues to move along the roll forming machine through the next to the last pass 76. Partial formation of a joggle occurs even though the forming rolls preceding the last pass are not designed to create the joggle, apparently because the recess 58 does not provide support for the overlying parts of the metal strip 36 as it is progressively formed to the contour of the left side forming rail 56 and the sheet metal is effectively progressively pushed or pulled partly into the recess 58.

Figure 10:
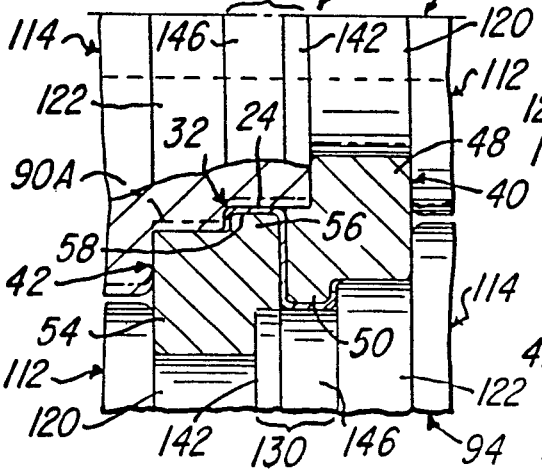

In the particular roll forming machine 70 shown in FIGS. 3 through 10, the joggle 32 is finally and completely formed at the last pass 78 as the joggle-forming recess 58 travels therethrough, which is at the point in time represented in FIG. 10. In this last pass 78, the upper forming roll assembly 90 is so constructed that its downwardly facing surfaces are spaced upwardly from the upwardly facing surfaces of the mandrels 40 and 42 during at least most of the travel of the workpiece throught the last pass 78, as indicated by phantom lines 90A. The spacing is such that the center subsection may be moved downwardly under the hydraulic pressure of the cylinders 104 to enable the joggle 32 to be fully formed. To this end, the upper roll assembly 90 must be so constructed that the downward movement of the upper roll assembly 90 required to completely form the joggle 32 will not be prevented by interference between the upper roll assembly 90 and the mandrels 40 or 42 or the lower roll assembly 94. Center subsection 146 of the upper forming roll 90 of the last pass is caused to engage along the entire portion of the raw metal formed to provide the upper leg 24 by the pressure exerted downwardly by the hydraulic actuaters 104. This pressure is sufficient that the raw metal is fully depressed into the joggle-forming recess 58 as it passes under the upper forming roll 90. The pressure exerted by the hydraulic actuators 104 is preferably constant throughout the operation of the roll forming machine but, with sophisticated controls, the pressure could be varied in timed relation to the passage of a joggle-forming recess through the machine.

The structural member 20 is thus completely formed with no need for a separate joggle-forming operation and the metal in the area of the joggle 32 is subject to lesser degrees of stresses and strains because of the partial formation of the joggle that occurs during earlier stages of the roll forming process. Upon exiting the roll forming machine, the now-completed structural member 20 is disassembled from the mandrels 40 and 42, which may be repeatedly reused for forming other, identical structural members.

It may be noted that each of the several forming roll assemblies 90 and 94 can be formed in one piece as shown in FIG. 10. Optionally, the several sections and subsections of the forming roll assemblies 90 and 94 may be made in individual sections or in groups of sections. All sections are, of course, keyed to their associated roll spindles 92 or 96, as by pins (not shown), and rotated in unison therewith.

Plural structural members 20 may be made from a continuous strip of raw metal using one-piece mandrels which are sufficiently long for this purpose. Optionally, both mandrels 40 and 42 could be replaced by an endless loop of plural interconnected mandrel sections or mandrels that circulate continuously through the successive passes of the roll forming machine substantially in the manner disclosed in FIGS. 3 and 7–11 of said Brooks, Jr. et al. '057 patent but with two side by-side continuous mandrel loops or with one continuous mandrel loop supported as shown in FIG. 3 of said Brooks, Jr. et al. '057 patent and another continuous mandrel loop passing over the tops of the roll stands. A cutting station may also be provided downstream from the last station or stations 78 to sever each newly formed structural member 20 from those being formed. Parts of the ends of the structural members may also be trimmed as desired at a cutting station.

As is apparent, more than one joggle may be formed by the simple expedient of providing additional recesses 58. The last pass 78 is not constructed to form joggles in the lower leg 28 of the return flange Z-shaped structural member 20 because the axis of rotation of the lower forming roll assembly 94 is fixed. However, one could bias the lower forming roll assembly 94 of the last pass 78 by hydraulic cylinders (not shown) to enable formation of one or more joggles in the lower leg 28. The arrangement could be the same as disclosed for one of the stands 180 shown in FIG. 5 of said Brooks et al '499 patent wherein both the upper and the lower forming roll assemblies are hydraulically biased. As a further option, only the lower forming roll assembly need be biased by hydraulic cylinders, as shown in FIGS. 1 and 2 of said Brooks et al. '499 patent, if the upper leg of the structural member is not to include one or more joggles.

As may be readily understood, hydraulic actuators could be used to bias either the upper or the lower or both roll assemblies at several or all of the passes in order to accommodate variations in the characteristics of the metal stock as disclosed in the Brooks et al. '499 patent. As those familiar with tooling for roll forming machines will be aware, the use of properly constructed, hydraulically-biased roll assemblies would enable the progressive formation of any joggles with minimal strains and stresses. If desired, to prevent the premature formation of a joggle at an upstream pass having hydraulically biased roll assemblies, the upstream roll assemblies may be so constructed that they cannot be pressed downwardly by their associated hydraulic cylinders through a distance which would cause such premature formation of the joggle. This could be accomplished, for example, by constructing the upper forming roll assembly such that its engagement with the mandrels or the lower roll assembly prevents excessive downward movement of the upper forming roll. Although the biasing of the forming rolls is preferably accomplished by the use of hydraulic actuators as disclosed in the Brooks et al. '499 patent, known biasing springs may be used instead.

Figure 11:
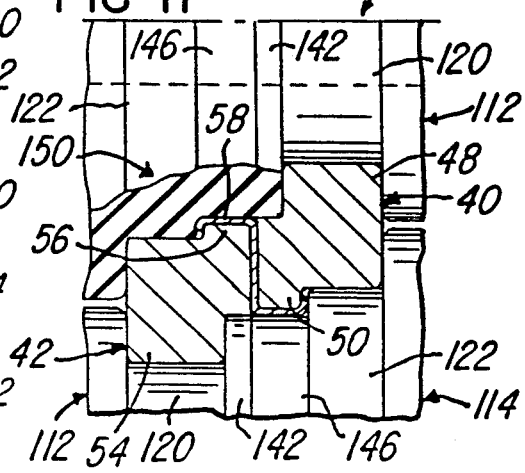
FIG. 11 is a view similar to FIG. 10 of the last pass of a roll forming machine in accordance with a second embodiment of this invention and showing the formed structural part and the mandrels exiting therefrom in cross section.

Referring to FIG. 11, a modified embodiment of the upper roll assembly for a last pass, generally designated 78A, of a roll forming machine in accordance with this invention includes an upper forming roll assembly having an elastomeric roll sleeve 150 of the type described in said Brooks, Jr. et al '057 patent, so constructed that the elastomeric roll sleeve 150 is self-biased to push against the portion of the metal strip 36 passing over a joggle-forming mandrel recess 58 to cause the metal strip to conform to the contours of the recess 58. At other times, the elastomeric roll sleeve 150 flexes sufficiently to permit the workpiece 38 to travel through the last pass 78A without obstruction. The last pass 78A may be used in the roll forming machine 70 instead of the last pass 78 illustrated in FIG. 10. As in all other cases, plural last passes conforming generally to that illustrated in FIG. 11 may be used instead of a single last pass.

In a modification, deemed especially useful when the diameter of the center, part-forming roll subsection 146 must be large in relation to the length of the joggle to be formed, one or more passes conforming to the pass 78A in FIG. 11 could be located downstream of one or more passes 78 conforming to that shown in FIG. 10. If a hard metal roll subsection, such as subection 146 shown of FIG. 10, is too large to press the ends of a joggle into a joggle-forming mandrel recess, the joggle cannot be fully formed by the hard metal roll subsection. The elastomeric sleeve 150, however, may be made sufficiently resilient that it will fully press the raw metal into the joggle forming recess to complete a joggle-forming operation.

In some cases, it will be an advantage to externally bias a roll having an elastomeric sleeve as by hydraulic actuators as described above. This will depend upon the compressibility of the elastomeric sleeve which may limit the tolerable variations in metal thickness, or depth of the joggle, that can be accommodated by the compressibility of the sleeve. By additionally providing an external bias, whether hydraulic or mechanical, larger variations in metal thickness and deeper joggles can be accommodated.

With reference to FIG. 12, a modified return flange Z-shaped structural member 160 is illustrated that comprises a central web 162, an upper leg 164 having a joggle 166 and an upper return flange 168 projecting downwardly from its outer edge, and a lower leg 170 having a lower return flange 172 extending upwardly from its outer edge. A pair of alignment apertures 174, one passing through each end of the web 162, may also be provided for the same purpose as the alignment bores 44 of the first embodiment. The modified return flange Z shaped structural member 160 may be identical to the structural member 20 of FIG. 1, except that the modified structural member 160 has a relatively thin-walled, first end portion 176 and a relatively thick-walled second end portion 178 joined to the first end portion by a transition portion 180 having a tapering thickness.

With reference to FIG. 13, the modified structural member 160 is made from raw material comprising an elongate, generally planar, thin-walled strip, generally designated 182, of a metal suitable for roll forming. In contrast to the metal strip 36, which is uniformly thick within relatively small tolerances, the metal strip 182 for the modified structural member 160 has a thin right end portion 183, as viewed in FIG. 13, a substantially thicker left end portion 184, and a transition portion 186 of tapering thickness. Manufacture of the metal strips, such as strip 182, with different thickness at longitudinally different regions along their length is readily accomplished using commercially available primary reduction rolling equipment, such as may be obtained from L & F Industries, 2110 Belgrave Avenue, Huntington Park, Calif. 90255.

In order to produce the modified structural member 160 of FIG. 12 from the strip 182, a unitary workpiece 188 is formed by assembling the strip 182 between a pair of elongate forming mandrels comprising a right side forming mandrel 190 and a left side forming mandrel 192 which may be held together with the strip 182 by a pair of alignment pins 194 during the roll forming operation, as will be readily apparent from the preceding description of the first embodiment.

The forming mandrels 190 and 192 for producing the modified structural member 160 are similar to the forming mandrels 40 and 42 of the first embodiment. Thus, the right side forming mandrel 190 comprises a rigid, roll engaging body 194 which is generally rectangular in transverse cross section and has a protuberant forming rail 196 extending along the entire length of its lower left side portion and the left side forming mandrel 192 comprises a rigid roll engaging body 198 which is generally rectangular in transverse cross section and has a protuberant forming rail 200 extending along the entire length of its lower left side portion. However, the mandrels 190 and 192 of FIGS. 13 and 14 are shaped to accommodate the different thicknesses of the raw strip 182. To this end, the surface, designated 202, of the right side mandrel 190 that confronts the strip 182 is recessed at 204 and the surface, designated 206, of the left side mandrel 192 that confronts the strip 182 is recessed at 208, the recessed portions 204 and 208 being adapted snugly to receive between them the thicker end portion 184 of the strip 182 when the workpiece 188 is assembled.

FIG. 14 shows a pair of roll assemblies comprising an upper roll assembly, generally designated 220, and a lower roll assembly, generally designated 222, which are representative of the type of tooling that can be used to form the structural member 160. The upper roll assembly 220 includes a right side roll section 224, a left side roll section 226, and a center roll section, generally designated 228. Lower roll assembly 222 has a complementary set of left side, right side, and center roll sections, also designated 224, 226, and 228 respectively. Each center roll section 228 includes a center spindle (not shown) and an elastomeric sleeve 230, such as shown in said Brooks, Jr. et al. '057 patent, preferably bounded or clad on its sides by a pair of metal wear plates 232 and 234. The elastomeric sleeves 230 laterally expand and contract to accommodate for the differences in thickness of the structural member 160. The wear plates 232 and 234 protect the elastomeric sleeves 230 from destructive abrasion that could occur as the result of the sliding friction between the center section 228 and parts of the workpiece 188.

At the particular point in time represented in FIG. 14, the thicker part 184 of the strip 182 is passing through the roll station or pass so that the center section sleeves 230 are laterally contracted, whereupon an open gap 236 is formed between each of the center sections 228 and their respective adjacent side sections 226. Other passes of the roll forming machine of which the pass illustrated in FIG. 14 is a part would preferably also include elastomereric roll sections to accommodate for changes in material thickness.

If one or more joggles were to be formed in the widest portion of the structural member 160, the joggle-forming pass or passes would preferably be so constructed that there are no air gaps, such as the gaps 236, existing when the thicker part of the sheet metal blank passes through the roll assemblies so that the joggle or joggles in the wider sections will be satisfactorily completed by operation of the biased or self-biased roll sections as discussed above. The last joggle-forming pass could, for example, be constructed the same as the pass shown in FIG. 10 or the pass shown in FIG. 11, but with an upper center roll section sufficiently wide to complete a joggle extending the entire width of the widest part of the top leg 164 and to provide a path between the side roll sections 224 and 226 along which the widest part of the structural member being formed can move without substantial interference. Of course, the narrower parts will readily move along the wider path.

In FIGS. 12 through 14, the centerline of the metal mass of the entire raw metal strip 182 is in a single vertical plane and the recessed parts 204 and 208 of the two mandrels 190 and 192 are of equal depths so that the centerlines of the metal mass of all parts of the center leg 162 of the completed structural member 160 are in a common plane. The same is not true of the top leg 164, the entire top surface of which is planar, except in the area of the joggle 166. Accordingly, the centerline of the metal mass of the thinner portion of the top leg 164 is on a plane that is vertically offset from the plane containing the centerline of the thicker portion. This may be understood from a comparison, in FIG. 14, of the differences in location of the side surfaces of the two different thickness of materials, the sides of the thinner section being shown by phantom lines 176A in FIG. 14. There it may be noted that the thicker and thinner parts of the bottom leg 170 also have vertically spaced horizontal centerlines.

Figure 15:
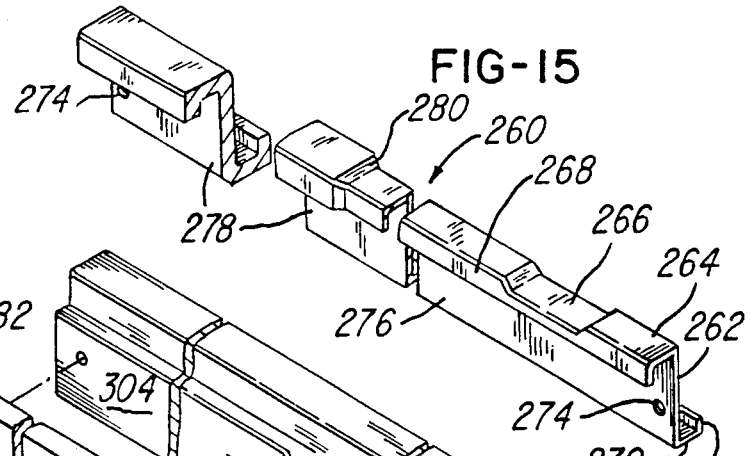
FIG. 15 is a fragmentary perspective view of a second embodiment of a return flange Z-shaped structural member having different metal thicknesses made in accordance with this invention.

Variations in the confronting surfaces of the mandrels 190 and 192 between which is sandwiched the parts of the metal strip 182 from which the middle leg 162 is formed conform to the variations in thickness of the metal strip 182 so that these parts of the formed structural member 160 undergo no forming operations. Such need not always be the case, as will now be described with reference to FIGS. 15 through 22. In FIG. 15, a modified return flange Z-shaped structural member 260 is illustrated that comprises a central web 262, an upper leg 264 having a joggle 266 and an upper return flange 268 projecting downwardly from its outer edge, and a lower leg 270 having a lower return flange 272 extending upwardly from its outer edge. A pair of alignment apertures 274, one passing through each end of the web 262 may also be provided for the same purpose as the alignment bores 44 of the first embodiment.

The modified return flange Z-shaped structural member 260 of FIG. 15, akin to the modified structural member 160 of FIG. 12, has a relatively thin-walled, first end portion 276 and a relatively thick-walled second end portion 278 joined to the first end portion by a transition portion 280 having a tapering thickness. It differs from the structural member 160 of FIG. 12 in that the distribution of the metal mass of the thicker, second end portion 278 relative to the centerlines of the metal mass of the first, thinner end portion 276 is different. As previously noted, the centerline of the metal mass of the central web 162 of the structural member 160 of FIG. 12 is coplanar throughout its length. In contrast, the metal mass of the central web 262 of the structural member 260 of FIG. 15 is so distributed that one face, rather than the centerlines, of the central web 262 is coplanar along its entire length. Accordingly, the opposite face of the central web 262 has two planar surface portions located on two different, parallel planes and connected by the transition portion 280. The structural member 260 of FIG. 15 differs from the structural member 160 of FIG. 12 in the the upper face of the upper leg 174 of FIG. 12 is flat or coplanar throughout its length (excepting, of course, any joggle 166) so that its lower face lies in two different planes. The opposite condition exists in the structural member 264, as is apparent from a comparison of FIG. 12 with FIG. 15.

In accordance with this invention, the metal mass of the central web 262 is formed "off center" or to any other desired configuration using a roll forming machine by which the parts of the raw metal between confronting mandrel surfaces are pressed or ironed into the desired configuration by the mandrels, which in turn are pressed toward one another by the side roll sections of the forming roll assemblies. As an alternative, the workpiece assembly could first be passed between one or more side roll stands (not shown) to press the mandrels toward one another to form the sheet metal mass between them. The side stands could be entirely conventional, having either solid metal or elastomeric rolls. Side stands are well known in the art. See the paragraph beginning column 4, line 66 of said Brooks, Jr. et al. '057 patent. Parts of the raw metal not clamped between mandrel surfaces are gradually formed by successive passes to the desired configuration. The mandrels preferably have rounded edges so that they can be easily guided into the first roll forming station and/or the forming rolls of the first pass or passes could be bevelled to guide the workpiece into such pass or passes.

Figure 16:
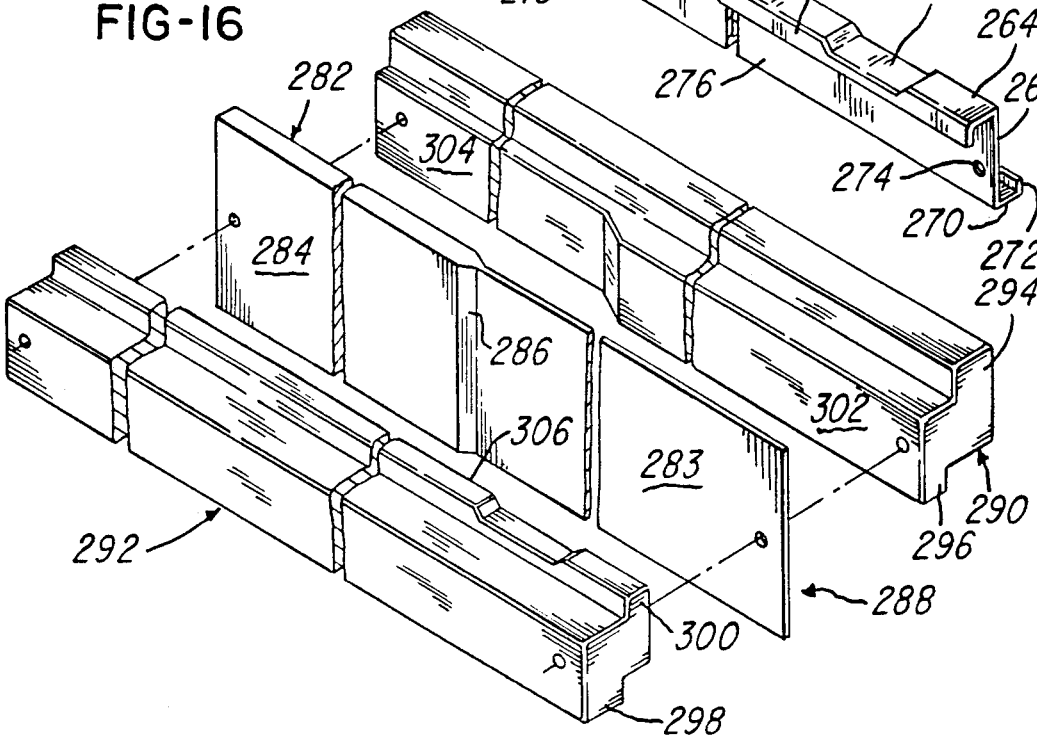
FIG. 16 is an enlarged, fragmentary, exploded perspective view of a pair of mandrels and the raw sheet metal used to form the return flange Z-shaped structural member of FIG. 15.
Figure 18:
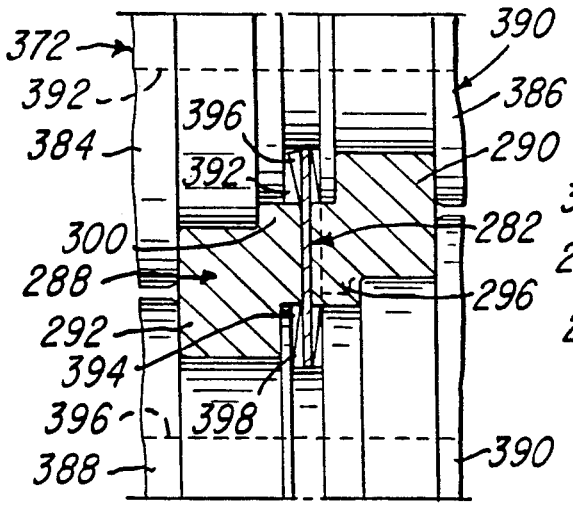
FIG. 18 is a fragmentary elevational view of the forming roll assemblies of the first pass of the roll forming machine of FIG. 17 as viewed in the direction of arrows 18—18 thereof and showing the raw sheet metal and the mandrels exiting therefrom in cross section.

Thus, with reference to FIG. 16, the modified structural member 260 of FIG. 15 is made from an elongate, generally planar, thin-walled strip, generally designated 282, of a metal suitable for roll forming, which strip may be identical to the raw material strip 182 of FIG. 13, and which has a thin right end portion 283, as viewed in FIG. 18, a substantially thicker left end portion 284, and a transition portion 286 of tapering thickness.

In order to produce the modified structural member 260 of FIG. 15 from the strip 282, a unitary workpiece 288 is formed by assembling the strip 282 between a pair of elongate forming mandrels comprising a right side forming mandrel 290 and a left side forming mandrel 292 which ma be held together with the strip 282 by a pair of alignment pins (not shown) during the roll forming operation. (For reasons which will become apparent, the holes that receive the alignment pins may be oversized with respect to the pins so that the pins can pass through the holes when the workpiece 288 is first assembled, at which time the mandrels 290 and 292 are not fully parallel.)

The forming mandrels 290 and 292 for producing the modified structural member 260 of FIG. 15 are similar to the forming mandrels 190 and 192 illustrated in FIG. 13. Thus, the right side forming mandrel 290 comprises a rigid, roll-engaging body 294 which is generally rectangular in transverse cross section and has a protuberant forming rail 296 extending along the entire length of its lower left side portion and the left side forming mandrel 292 comprises a rigid roll-engaging body 298 which is generally rectangular in transverse cross section and has a protuberant forming rail 300 extending along the entire length of its upper right side portion. However, to form the structural member 260 of FIG. 15, only the right side mandrel 290 of FIG. 16 is shaped to accommodate the different thicknesses of the raw strip 282. To this end, the surface, designated 302, of the right side mandrel 290 that confronts the strip 282 is recessed at 304 and the confronting surface, designated 306, of the left side mandrel 292 is uniformly planar and not recessed. Accordingly, when the workpiece 288 is first assembled, there is a mismatch between the thicker end portion 284 of the strip 282 and the mandrels 290 and 292, which initially prevents the mandrels 290 and 292 from being located parallel to one another. The mismatched condition is cured during the roll forming process by forcing the metal mass of the thicker end 284 to be so displaced that its center line is offset from the centerline of the thinner end portion 283 whereupon the web portion of the thicker end portion 284 completely fills the pocket 304.

Figure 17:
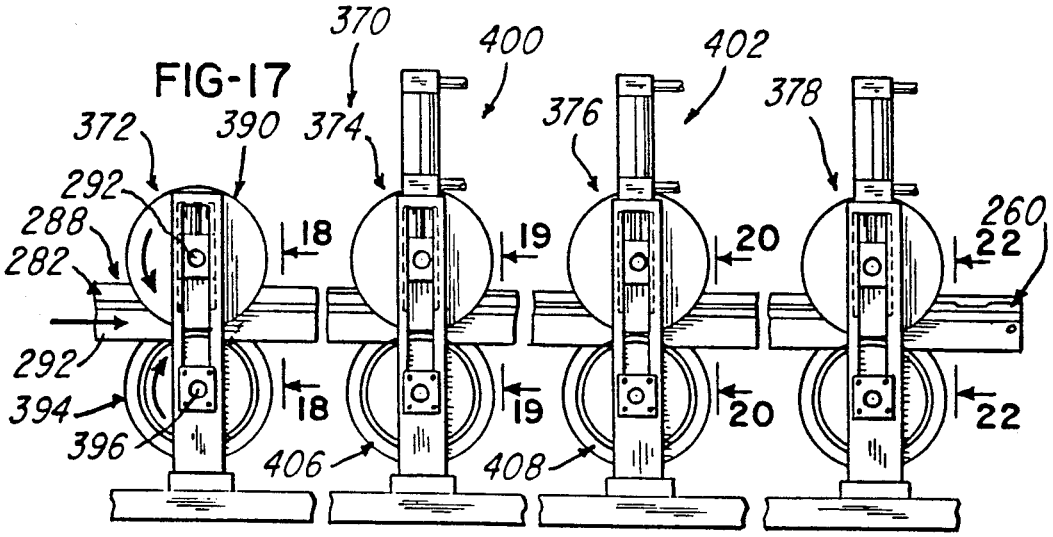
FIG. 17 is a simplified, fragmentary front elevational view of a portion of a roll forming machine especially tooled and operable in accordance with this invention and showing some of the progressive steps taken to form the return flange Z-shaped structural member of FIG. 15.

With reference to FIG. 17, a portion of a roll forming machine, generally designated 370, illustrated in simplified form, is shown tooled to progressively form the planar metal strip 260 into one or more return flange Z-shaped structural members 260. In many respects, the machine 370 may be identical to the machine 70 of FIG. 3, but differs as to tooling shapes and devices, all in a manner that will be familiar to those skilled in the art. Briefly, the portions of the machine 370 illustrated in FIG. 17 include four forming stations or "passes" generally designated 372, 374, 376 and 378. Parts of these passes are shown respectively in FIGS. 18, 19, 20, and 22. Sections of passes intermediate these passes may include a fifth pass 380 shown in FIG. 21. Other passes may be used and some of the passes may be duplicated for one reason or another. As with other roll forming practices, some structural members may require the use of more passes while other structural members may require the use of fewer passes.

Referring to FIGS. 17 and 18, the first pass 372 comprises an upper forming roll assembly, generally designated 390, affixed to an upper roll spindle 392 for rotation therewith and a lower forming roll assembly, generally designated 394, affixed to a lower roll spindle 396 for rotation therewith. The function of the first pass 372 is twofold. First, it forces the portions of the raw metal sandwiched between the mandrels 290 and 292 to conform to the confronting mandrel surfaces. As the trailing end of the workpiece 288 which includes the thicker left end portion 284 of the raw metal strip 282 enters the first pass 372, the entire metal mass between the mandrels is forced into the pocket 304 because the workpiece 288 is confined for movement between a pair of spaced upper side roll portions 384 and 386 and a pair of lower side roll portions 388 and 390. An upper cavity 392 and a lower cavity 394 are provided by the configuration of the upper and lower forming rolls to permit the entire width of the portions of the metal strip above and below the confronting surfaces of the mandrels 290 and 292 to move without obstruction through the first pass 372. As can be seen in FIG. 18, these portions may become curved as indicated at 396 and 398 because of the working of the center of the thicker end portion.

The second function of the first pass 372 is to guide the forming mandrels 290 and 292 along predetermined horizontal and vertical planes. Other similar passes (not shown) may be provided that function solely to maintain the proper path of the workpiece 288. These passes preferably have roll assemblies that are adjustably fixed both vertically and horizontally. Such passes may be necessary or at least desirable for use between other passes having forming roll assemblies that move to accommodate variations in metal thickness. The passes having fixed roll assemblies, of course, must be so constructed that the thickest parts of the metal strip 282 can pass therethrough without obstruction.

Figure 19:
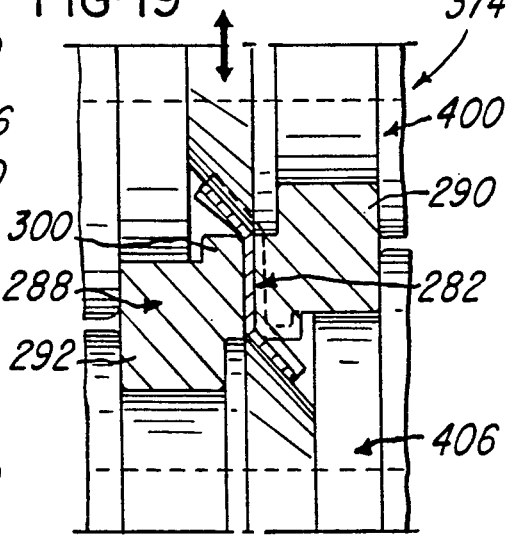
FIGS. 19, 20, 21, and 22 are fragmentary elevational views similar to FIG. 18 of successive passes of the roll forming machine of FIG. 17 and showing progressive steps in the formation of the return flange Z-shaped structural member of FIG. 15.
Figure 20:
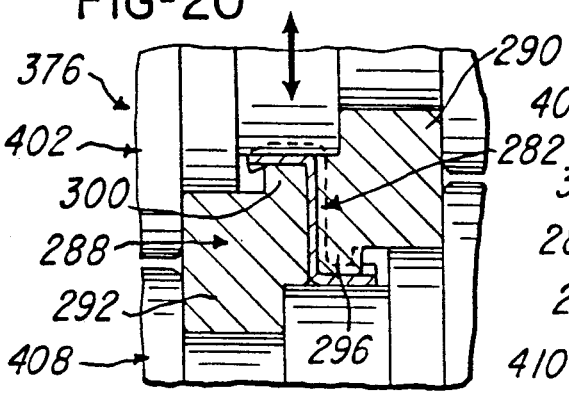
Figure 21:
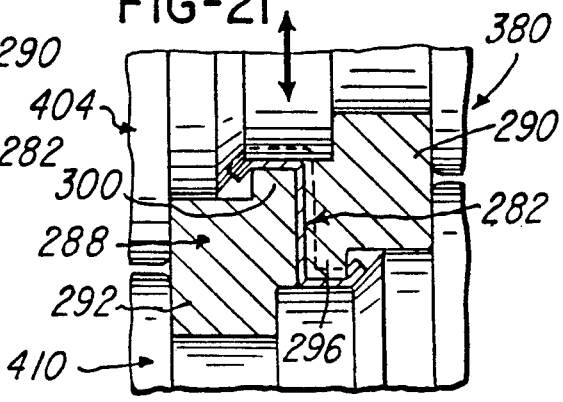

The function of the successive passes illustrated in FIGS. 19, 20, and 21, is to force the parts of the metal strip 282 not located between confronting mandrel surfaces to conform to the forming rails 296 and 300. It may be noted that each has an upper forming roll assembly, designated 400, 402, and 404, respectively, hydraulically biased to accommodate differences in metal thickness. The lower forming roll assembly of each pass, designated 406, 408, and 410, respectively, may be adjustably fixed due to the particular configuration of the modified structural member 260 of FIG. 15, since the downwardly facing surfaces of the modified structural member 260 are in a uniform plane throughout their length, the variation in metal thickness appearing in the upwardly facing surfaces thereof.

It may be noted in FIGS. 19, 20, and 21, that the upper forming rolls 400, 402, and 404, are so constructed that they force the portions of the metal strip 282 located above the confronting surfaces of the mandrels 290 and 292 into such intimate contact with the forming rail sections 296 and 300 thereof that the thicker metal mass of the left end portion of the structural member 260 is moved upwardly or outwardly as the case may be in accordance with the design of the structural member 260. Thus, the thicker metal mass is formed "off center" gradually as the workpiece 288 moves from pass to pass.

As those familiar with the art will readily appreciate, elastomeric rolls or other special tooling may be required to cause the raw metal strip 282 to fully conform to the forming surfaces of the mandrels 290 and 292.

Figure 22:
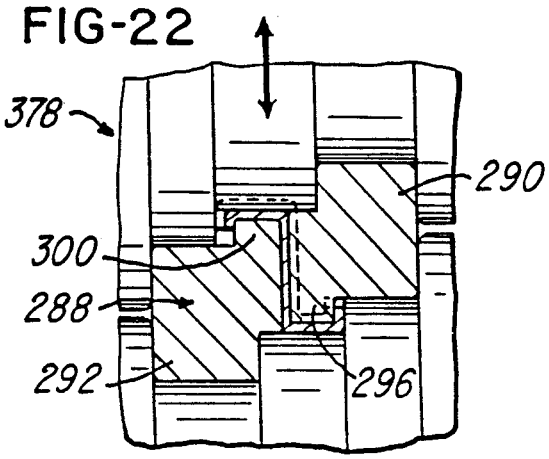

Pass 378 illustrated in FIG. 22 is a final, joggle-forming pass, the construction and operation of which will be apparent from the foregoing description. The earlier passes that include hydraulically-biased rolls do not interfere with the formation of, or prematurely form, a joggle because the rolls of such earlier passes are prevented, as by mutual engagement of the side roll sections of their upper and lower roll assemblies, from moving through a distance sufficient to adversely effect the formation of the joggle or joggles.

Figure 23:
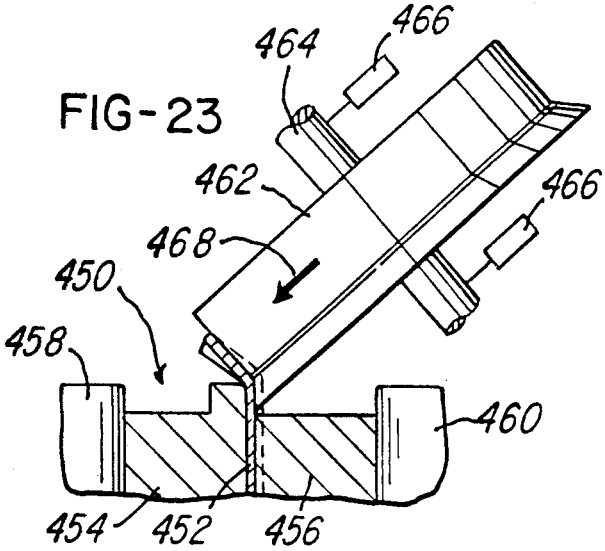
FIG. 23 is a simplified, partly diagrammatic, fragmentary elevational view with parts shown in section and with parts removed illustrating a portion of another embodiment of a pass of a roll forming machine especially tooled and operable in accordance with this invention that may be used in the process of forming the return flange Z-shaped structural member of FIG. 15.

FIG. 23 is a diagrammatic and schematic representation of special tooling that may be used in carrying out the method of this invention. In FIG. 23, a workpiece assembly, generally designated 450, comprising a raw metal strip 452 and a pair of forming mandrels 454 and 456, is shown guided between a pair of side rolls 458 and 460. Forming of the metal strip 452 is carried out in part by a forming roll 462 mounted on a roll shaft 464 supported by any suitable means (not shown) for rotation about an axis that is approximately 45 degrees relative to horizontal. Roll shaft 464 is biased by a pair of hydraulic cylinders 466 in the direction of the arrow 468 shown in FIG. 23. Those familiar with the art will recognize that the tooling illustrated in FIG. 23 is a variation of a conventional turkshead. It may be noted in FIG. 23 that the mandrels 454 and 456 are shaped differently from the mandrels in the first and second embodiments in order to enable contact between the forming roll 462 and the metal strip 452.

Figure 24:
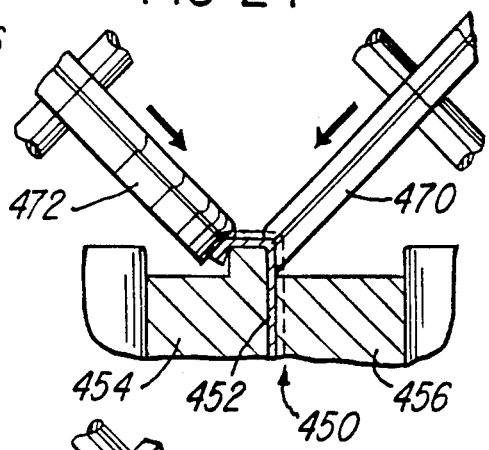
FIGS. 24 and 25 are fragmentary elevational views similar to FIG. 23 of other passes that may be used in the process of forming the return flange Z-shaped structural member of FIG. 15.
Figure 25:
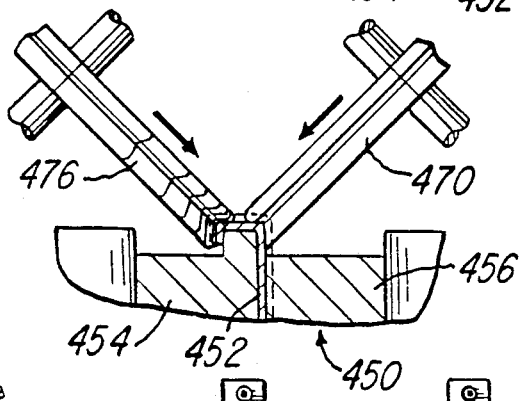

FIGS. 24 and 25 show additional passes with hydraulically biased rolls that rotate about axes other than horizontal or vertical and that may be used with the workpiece assembly 450 of FIG. 23. In FIG. 24, one such roll 470 holds the upper right corner of the structural member 452 being formed against the left side mandrel 454 while another hydraulically biased roll 472 is beginning to form the upper left corner of the structural member 452. The pass illustrated in FIG. 25 illustrates a hydraulically baised roll that performs the same function as the roll 470 of FIG. 24 and another hydraulically biased roll 476 that completes the formation of the upper left corner of the structural member.

Figure 26:
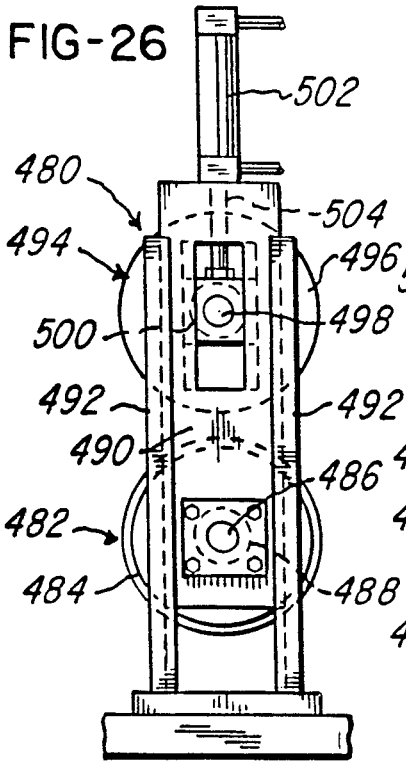
FIG. 26 is a simplified side elevational view, with parts omitted, of another embodiment of a pass of a roll forming machine that may be used in accordance with this invention.
Figure 27:
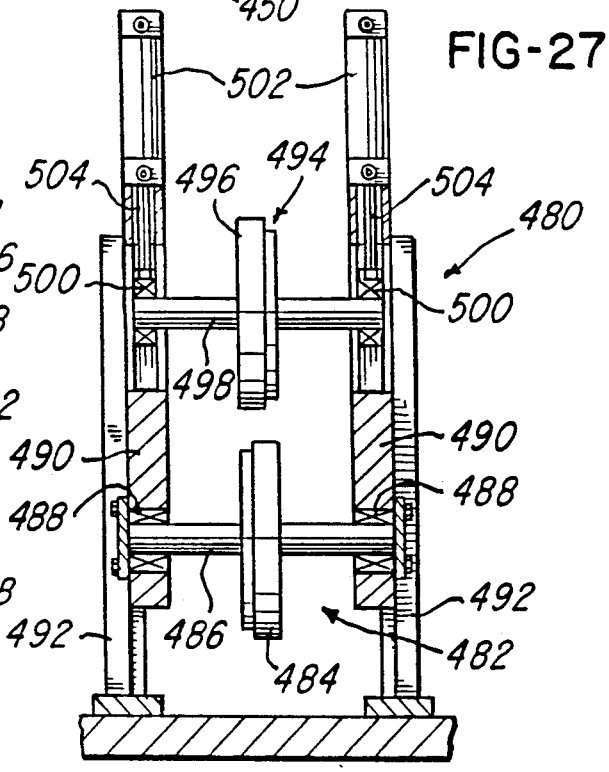
FIG. 27 is an elevational view of the pas of FIG. 26 with parts shown in cross section.

FIGS. 26 and 27 show a variant form of roll pass assembly, generally designated 480, which may be useful in the practice of this invention. Here the lower forming roll assembly, generally designated 482, that includes a lower roll 484 (only partly represented) mounted on a shaft 486 supported by bearings 488 connected to a pair of vertically movable plates or bridles 490 that are slidably mounted for vertical movement along stanchions 492. The upper forming roll assembly, generally designated 494, includes a roll partly illustrated at 496 mounted on a shaft 498 supported by bearings 500 that are slidably mounted relative to the sliding plates or bridles 490. A hydraulic actuator 502 is mounted on top of each of the bridles 490 and has a piston rod 504 contacting one of the bearings 500. As is apparent, the tooling illustrated in FIGS. 26 and 27 enables the lower forming roll assembly 482 and the upper forming roll assembly 494 to, in essence, "float" upwardly and downwardly relative to vertical and relative to one another in order to accommodate variations in the thickness of the raw material strip. Passes with relatively fixed rolls or the like, such as the pass 372 of FIGS. 17 and 18, would necessarily be used with the stands of the type illustrated in FIGS. 26 and 27 in order to confine the workpiece to the desired horizontal path.

It is now apparent that other embodiments of structural members (not shown) could have more than one relatively thick or relatively thin portion, or more than two different thicknesses. Furthermore, the techniques disclosed herein, utilizing appropriately shaped roll assemblies and mandrels, could be used to produce joggles in the vertical legs of Z-shaped structural members.

Because of the ability to use the two mandrels to produce return flange Z-shaped structural members with different thicknesses and with different distributions of the metal mass, structural designers will have substantially fewer restraints on the shapes of roll formed structural members, and particularly Z-shaped members, than in the past.

Figure 28:
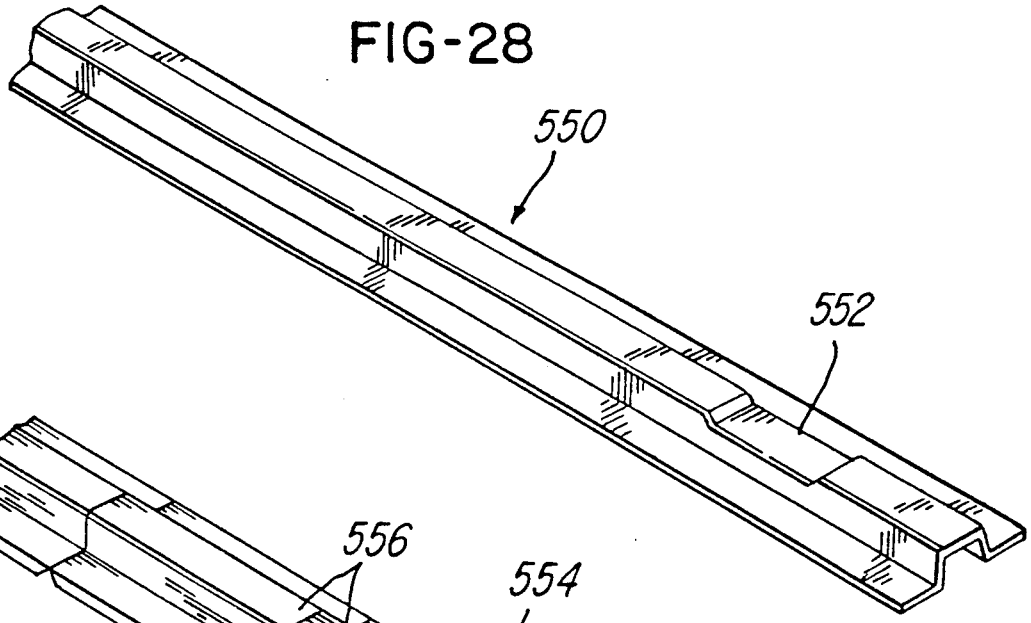
FIG. 28 is a perspective view of a hat-shaped structural member having a joggle that may be made in accordance with this invention.
Figure 29:
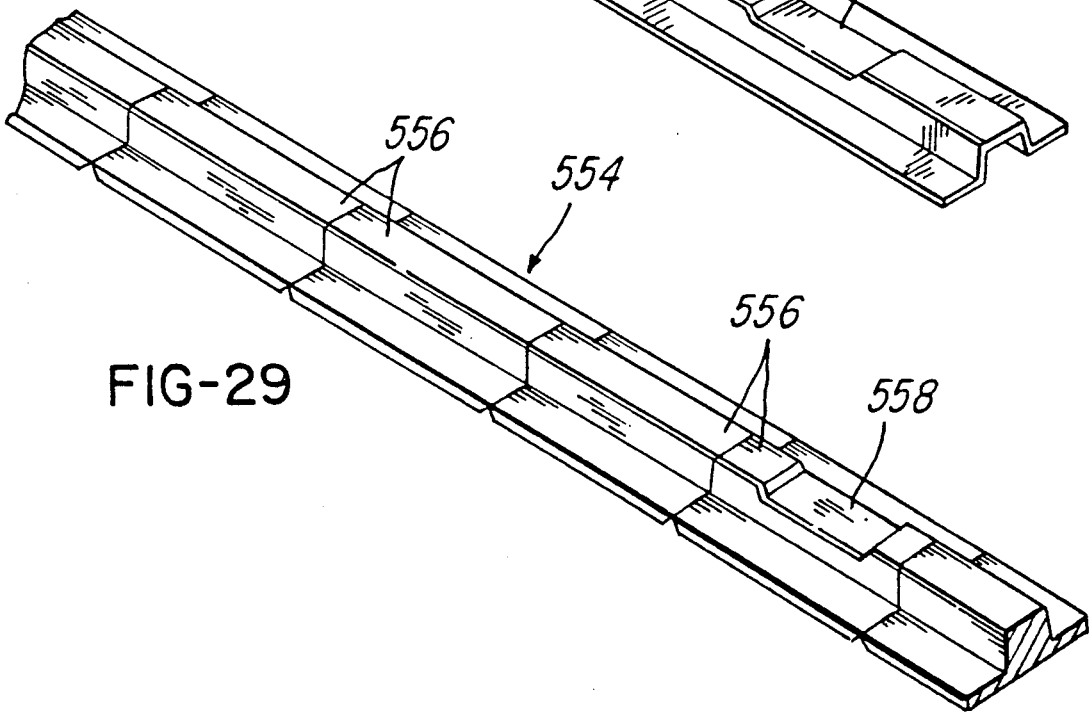
FIG. 29 is a perspective view of a mandrel that may be used in the production of the structural member of FIG. 28.

FIG. 28 shows a hat-shaped structural member, generally designated 550, made from a metal sheet and having a joggle 552 which may be made in accordance with this invention using a segmented mandrel, generally designated 554, shown in FIG. 29, and having plural mandrel sections 556 which are hinged together to form an elongate mandrel, which may be in the form of a continuous loop as disclosed in said Brooks, Jr. et al '057 patent. One of the mandrel sections 556 has a joggle-forming recess 558 used with a biased or self-biased roll assembly as described above to form the joggle 552. Of course, a one-piece mandrel (not shown) could be used instead of the segmented mandrel 554. The particular structural member 550 illustrated in FIG. 28 is made from uniformly thick sheet metal but it is apparent from the foregoing description that a similar structural member (not shown) could be made from sheet metal having different thicknesses.

Those familiar with the roll forming art are aware that, due to the resiliency of the raw metal from which structural members or other parts are formed, some overbending is required so that a formed part, after removal from the roll forming machine, will "spring back" to its designed shape. Accordingly, in this description and in the claims that follow, reference to the formation of a part to a "final configuration" or the like refers to the final configuration with allowance for spring back.

Although the presently preferred embodiments of this invention have been described, it will be understood that within the purview of this invention various changes may be made within the scope of the appended claims.

I claim:

1. A method for forming from an elongate sheet metal blank a one-piece, elongate, non-planar structural member, said method comprising the steps of:

providing a pair of elongate, rigid, forming mandrels, each of said forming mandrels having longitudinally-extending part-forming surfaces contoured to form parts of said structural member, and each of said forming mandrels having longitudinally-extending roll-engaging surface means for engaging upper and lower roll means at passes of a roll forming machine;

forming a workpiece comprising said forming mandrels in mutually confronting relation with a portion of said sheet metal blank positioned therebetween;

equiping a roll forming machine with a plurality of passes each of which has upper rolls and lower rolls, the upper rolls and the lower rolls of at least respective ones of said passes having contours differing from the contours of the corresponding rolls of at least some other passes, said rolls being configured to progressively form said blank over portions of said part-forming surfaces of said mandrels as said strip moves from pass to pass; and shaping parts of said sheet metal blank to predetermined contours matching said portions of said part-forming surfaces by passing said workpiece through said roll forming machine and thereby engaging said roll-engaging surface means of both of said mandrels by said rolls and thereby also engaging portions of said blank by said rolls to progressively form portions of said blank against portions of said part-forming surfaces of both of said mandrels.

2. The method of claim 1 wherein said sheet metal blank has longitudinally spaced sections of different thicknesses and said mandrels have confronting surfaces engaging said blank along its length that confine said blank therebetween, said confronting surfaces being contoured to match the contours of the portions of said blank confined therebetween.

3. The method of claim 1 wherein said sheet metal blank has longitudinally spaced sections of different thicknesses and said mandrels have confronting surfaces that confine said blank therebetween, said confronting surfaces being contoured so that sections of said blank between said mandrels are moved relative to other, longitudinally-spaced, sections of said blank between said mandrels as the workpiece progresses through said passes.

4. The method of claim 1 wherein said sheet metal blank has longitudinally spaced sections of different thicknesses and said mandrels and said upper and lower roll means are constructed so that the cross-sectional centerlines of the metal mass forming at least some of the sections of said blank shaped over said part-forming surfaces are retained in the same positions relative to the cross-sectional centerlines of the sheet metal mass forming other, longitudinally spaced sections of different thicknesses shaped over said part-forming surfaces.

5. The method of claim 1 wherein said sheet metal blank has longitudinally spaced sections of different thicknesses and said mandrels and said upper and lower roll means are constructed so that the cross-sectional centerlines of the metal mass forming at least some of the sections of said blank shaped over said part-forming surfaces are moved relative to the cross-sectional centerlines of the sheet metal mass forming other, longitudinally-spaced sections of different thicknesses shaped over said part-forming surfaces.

6. A method for forming from an elongate sheet metal blank a one-piece, elongate, Z-shaped structural member having a generally vertical middle leg, a generally horizontal upper leg, a generally vertical upper return flange extending along and projecting downwardly from said upper leg, a generally horizontal lower leg, and a generally vertical lower return extending along and projecting upwardly from said lower leg, said method comprising the steps of:

providing a pair of elongate, rigid, forming mandrels, each of said forming mandrels having longitudinally-extending part-forming surfaces contoured to form parts of said Z-shaped section, said part-forming surfaces of one of said mandrels being contoured to form portions of at least one of said legs and said part-forming surface of the other of said mandrels being contoured to form portions of at least the other of said legs, and each of said forming mandrels having longitudinally-extending roll-engaging surfaces for engaging upper and lower rolls at the passes of a roll forming machine;

forming a workpiece comprising said forming mandrels in mutually confronting relation with a portion of said sheet metal blank positioned therebetween;

equiping a roll forming machine with a plurality of passes each of which has upper rolls and lower rolls, the upper rolls and the lower rolls of at least respective ones of said passes having contours differing from the contours of the corresponding rolls of at least some other passes, said rolls being configured to progressively form said blank over portions of said part-forming surfaces of said mandrels as said strip moves from pass to pass; and shaping parts of said sheet metal blank to predetermined contours matching said portions of said part-forming surfaces by passing said workpiece through said roll forming machine and thereby engaging said roll-engaging surface means of both of said mandrels by said rolls and thereby also engaging portions of said blank by said rolls to progressively form portions of said blank against portions of said part-forming surfaces of both of said mandrels.

7. The method of claim 6 wherein said sheet metal blank has longitudinally spaced sections of different thicknesses and said mandrels have confronting surfaces engaging said blank along its length that confine said blank therebetween, said confronting surfaces being contoured to match the contours of the portions of said blank confined therebetween.

8. The method of claim 6 wherein said sheet metal blank has longitudinally spaced sections of different thicknesses and said mandrels have confronting surfaces that confine said blank therebetween, said confronting surfaces being contoured so that sections of said blank between said mandrels are moved relative to other, longitudinally-spaced, sections of said blank between said mandrels as the workpiece progresses through said passes.

9. The method of claim 6 wherein said sheet metal blank has longitudinally spaced sections of different thicknesses and said mandrels and said upper and lower roll means are constructed so that the cross-sectional centerlines of the metal mass forming at least some of the sections of said blank shaped over said part-forming surfaces are retained in the same positions relative to the cross-sectional centerlines of the sheet metal mass forming other, longitudinally-spaced sections of different thicknesses shaped over said part-forming surfaces.

10. The method of claim 6 wherein said sheet metal blank has longitudinally spaced sections of different thicknesses and said mandrels and said upper and lower roll means are constructed so that the cross-sectional centerlines of the metal mass forming at least some of the sections of said blank shaped over said part-forming surfaces are moved relative to the cross-sectional centerlines of the sheet metal mass forming other, longitudinally-spaced sections of different thicknesses shaped over said part-forming surfaces.

11. A method of manufacturing a roll-formed structural member of sheet metal having one or more joggles comprising the forming of said structural member over each of a pair of mandrels between which the sheet metal is confined and which move through successive passes of a roll forming machine along with said sheet metal, providing at least one of said mandrels with a recess for each joggle to be formed, each said recess conforming to the shape of the joggle by which it is to be formed, passing said sheet metal and said mandrels through successive passes of forming rolls progressively to form parts of the sheet metal to contours of portions of both mandrels and to progressively, partly from each joggle, and thereafter forcing portions of said sheet metal into each joggle forming recess to finally form each said joggle.

12. Apparatus for progressively changing the transverse cross-sectional configuration of an elongate strip of sheet metal, said apparatus comprising a pair of elongate mandrels each having first surface portions shaped to conform to the desired final configuration of surface portions of said strip and second surface portions shaped to engage portions of said strip so that said mandrels and said strip may be assembled together so that said strip is engaged by and confined between said second surface portions of said mandrels, a series of successive passes of forming roll assembles, each forming roll assembly including rolls shaped to provide an orifice through which said mandrels with said strip confined therebetween may pass, the shapes of said orifices of different passes being different from other passes so that the transverse cross-sectional configuration of said strip is progressively changed as said strip moves through said successive passes by progressively forming portions of said strip to said first surface portions of both of said mandrels.

13. The apparatus of claim 12 wherein said roll assemblies include rolls shaped to drivingly engage said mandrels to cause said mandrels with said strip confined therebetween to move through said successive passes.

14. In a roll forming machine of the type having a plurality of passes, each having pairs of forming rolls for progressively forming sheet metal, at least one of said forming rolls being rotatably driven, the improvement wherein a pair of mandrels are provided between which the sheet metal is confined as it moves from pass to pass and said forming rolls are contoured to engage said mandrels to cause said mandrels and said sheet metal, with said sheet metal confined between said mandrels, to move from pass-to-pass and said forming rolls are contoured to engage said sheet metal progressively to conform portions of said sheet metal to surfaces of both of said mandrels.

* * * * *